United States Patent [19]

Sparks

[11] 3,996,778

[45] Dec. 14, 1976

[54] LOADER AND UNLOADER FOR PLATE ROLL MACHINE

[75] Inventor: Charles H. Sparks, Eugene, Oreg.

[73] Assignee: Steel Structures, Inc., Eugene, Oreg.

[22] Filed: Dec. 8, 1975

[21] Appl. No.: 638,534

[52] U.S. Cl. ..... 72/134; 72/169; 214/1 P; 214/146.5

[51] Int. Cl.[2] ..... B21D 43/00; B21D 45/00

[58] Field of Search ..... 72/169, 133, 134, 170, 72/250, 426; 214/1 BB, 1 BD, 146.5, 1 P

[56] References Cited

UNITED STATES PATENTS

| | | | |
|---|---|---|---|
| 49,045 | 7/1860 | Valentine et al. | 72/169 |
| 1,291,669 | 1/1919 | Clark | 72/169 |

*Primary Examiner*—Milton S. Mehr
*Attorney, Agent, or Firm*—Klarquist, Sparkman, Campbell, Leigh, Hall & Whinston

[57] ABSTRACT

A loader and unloader for a plate roll machine has an extensible boom extending generally horizontally over the plate rolls of the machine from a stationary support frame to which the boom is pivoted at one end for vertical movement over the rolls. The boom telescopes through the action of a hydraulic cylinder from a retracted position in which the free end of the boom overlies the plate rolls to an extended position in which such free end extends outwardly beyond the plate rolls. Additional fluid cylinders pivot the boom vertically. A plate support carriage is pivoted to the free end of the boom for fore-and-aft tilting movement. The carriage has one or more rollers extending lengthwise of the boom for engaging and supporting a rolled plate at its upper inside surface. The boom is retracted and positioned vertically for supporting the plate as it is rolled in the plate rolls. The boom is extended while supporting the plate to remove the rolled plate endwise from the plate rolls, and is lowered while extended to lower the rolled plate to a support surface and disengage and withdraw the carriage from the plate.

18 Claims, 8 Drawing Figures

FIG. 1
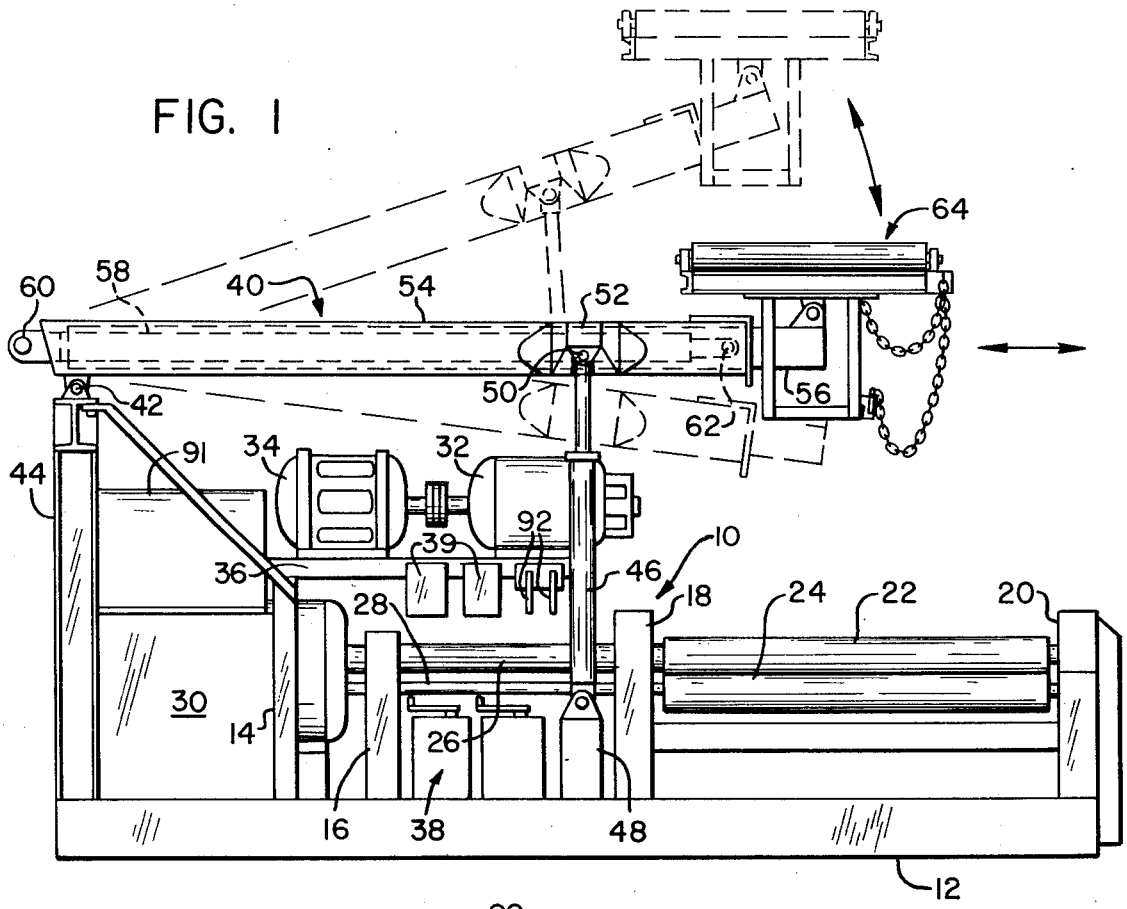
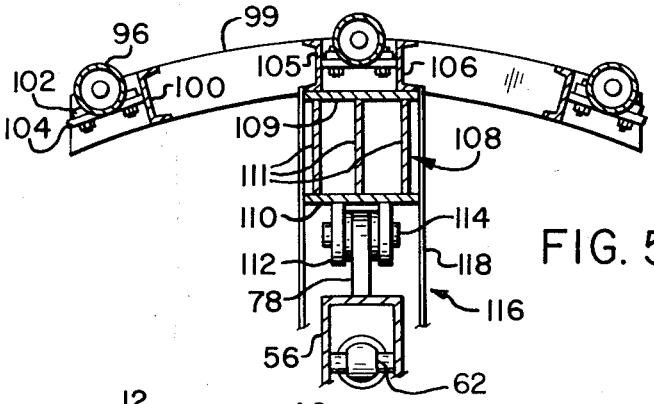
FIG. 5
FIG. 2
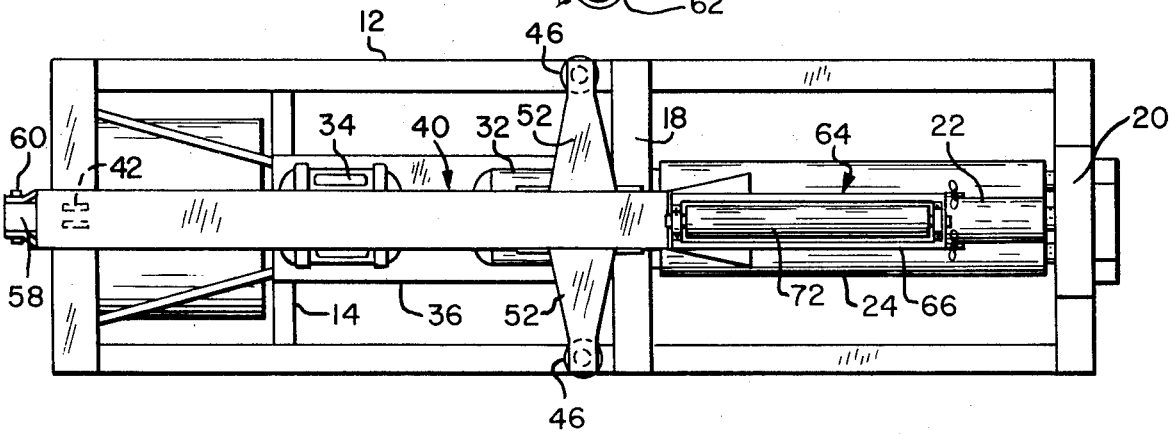

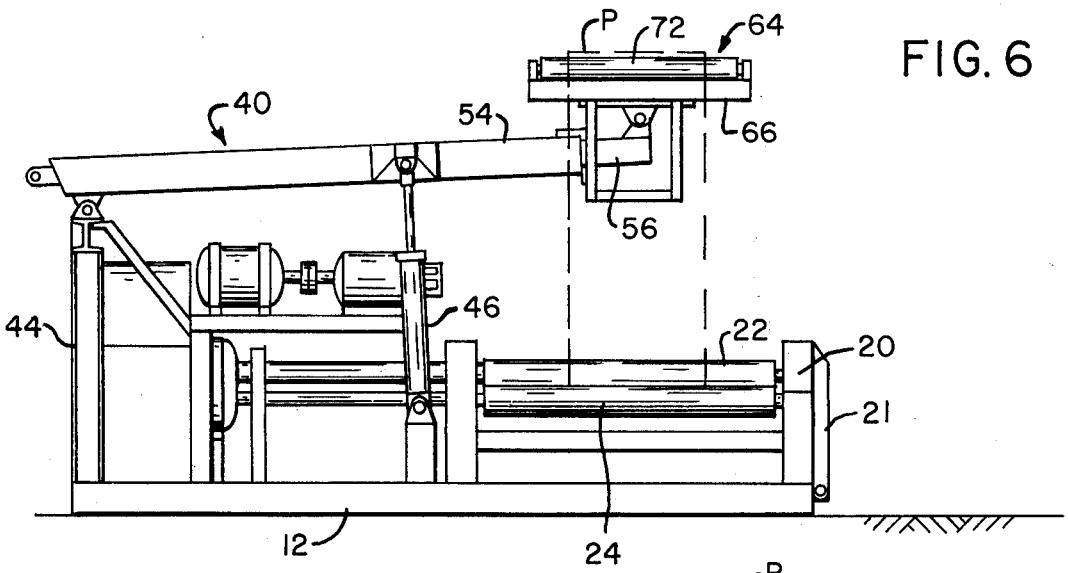
FIG. 6
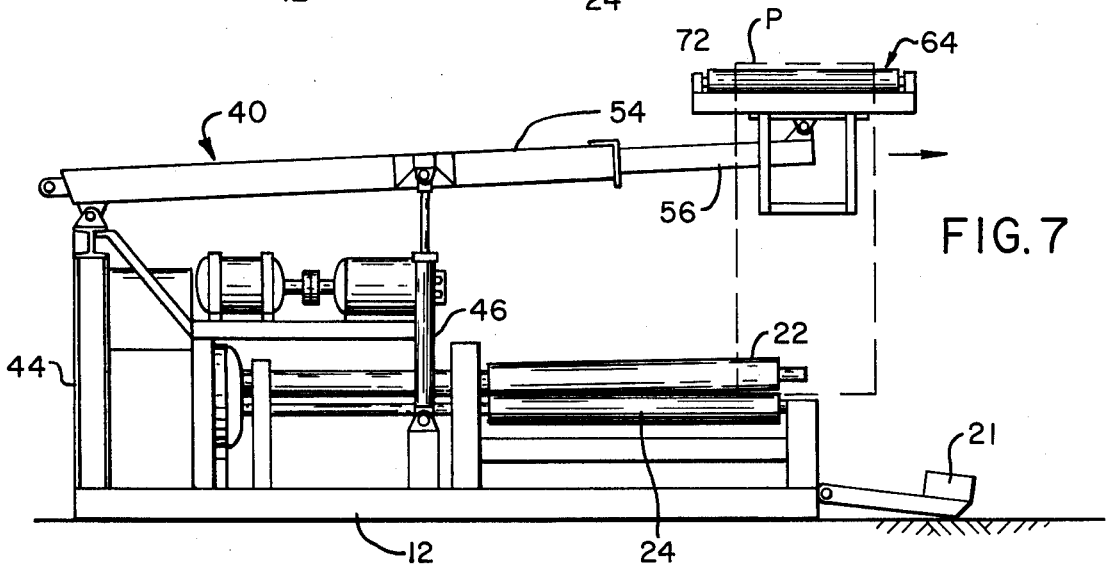
FIG. 7
FIG. 8
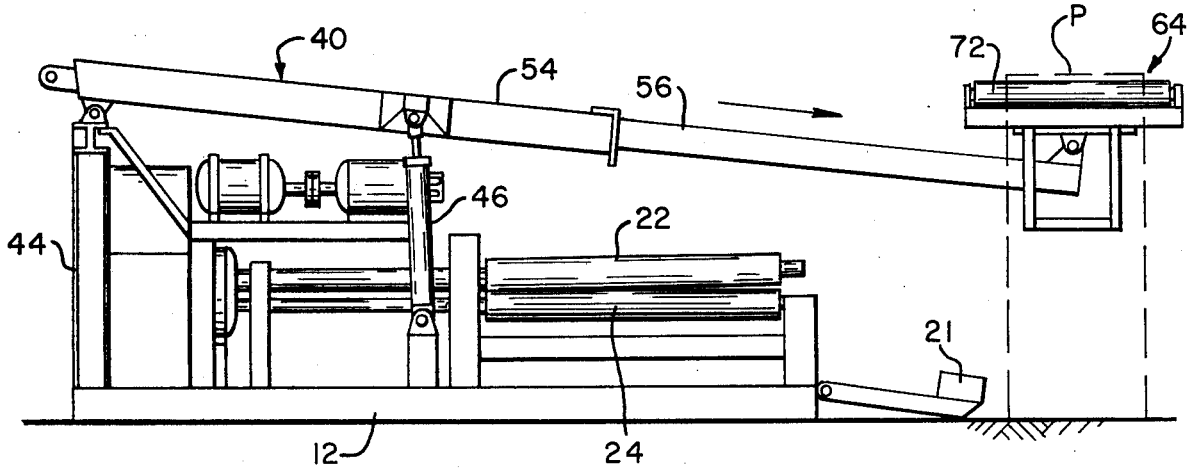

LOADER AND UNLOADER FOR PLATE ROLL MACHINE

BACKGROUND OF THE INVENTION

1. Field of the Invention

The present invention relates to an apparatus for loading rolled plate into the plate rolls and for unloading rolled plate from the plate rolls of a plate-rolling machine.

2. Description of the Prior Art

Plate roll machines are large machines used to roll flat steel or other metal plate into generally cylindrical tubular shapes of various diameters by passing the flat plate between a group of usually three long powered plate rolls which apply variable pressures to the plate to control the rolling diameter. Typically the plate rolls are driven from one end thereof and can be separated for inserting a plate to be rolled therebetween and for removing the rolled plate endwise therefrom. Heretofore the loading and unloading operations have required the use of large, expensive overhead cranes or mobile lift equipment with special attachments for grabbing and supporting large-diameter heavy rolled plate from its outer surface and exposed edges. Loading and unloading the plate rolls with rolled plate thus has been an expensive time-consuming operation requiring considerable manpower and heavy load-handling equipment which typically and inefficiently are idle as the rolling operation proceeds. There is thus a need for an improved, more efficient and less costly means for loading and unloading plate rolls.

SUMMARY OF THE INVENTION

In accordance with the present invention, an improved and greatly simplified loader and unloader for plate rolls is provided as a permanent part of or adjunct to the plate roll machine itself. The improved loader and unloader is characterized by an extensible boom which extends over the plate rolls from a stationary support structure which mounts the boom for vertical pivoting movement above the plate rolls. The extensible free end of the boom carries a rolled plate support carriage which supports the rolled plate from its inside surface as the plate is rolled and continues to support and carry the plate through extension of the boom to unload the plate endwise from the plate rolls. Loading the plate into the rolls is accomplished by reversing the foregoing procedure.

A primary object of the invention is to provide an improved loader and unloader which is incorporated as a permanent part of or adjunct to the plate roll machine itself.

Another primary object is to provide improved loader and unloader as aforesaid utilizing an extensible boom and rolled plate support carriage for supporting and handling rolled plate from the upper inside surface of the plate.

Another primary object is to provide an improved loader and unloader as aforesaid which handles rolled plate more quickly, more simply, more easily and with less manpower than prior loading and unloading devices.

Another important object is to provide a loader and unloader as aforesaid which is simpler in construction, less costly to build and operate and easier to maintain than prior loaders and unloaders.

Another important object is to provide an improved plate support carriage for a plate roll loader and unloader.

Another primary object is to provide a plate roll machine with a built-in loader and unloader.

The foregoing objects, features and advantages of the invention will become more apparent from the following detailed description which proceeds with reference to the accompanying drawings.

BRIEF DESCRIPTION OF DRAWINGS

In the drawings:

FIG. 1 is a side elevational view of a plate roll machine incorporating the rolled plate loader and unloader of the present invention;

FIG. 2 is a plan view of the apparatus of FIG. 1;

FIG. 5 is a vertical cross-sectional view of the carriage of FIG. 4; and

FIGS. 6, 7 and 8 are views illustrating the method of supporting and unloading rolled plate from the plate rolls in accordance with the invention.

DETAILED DESCRIPTION

Figure 3:
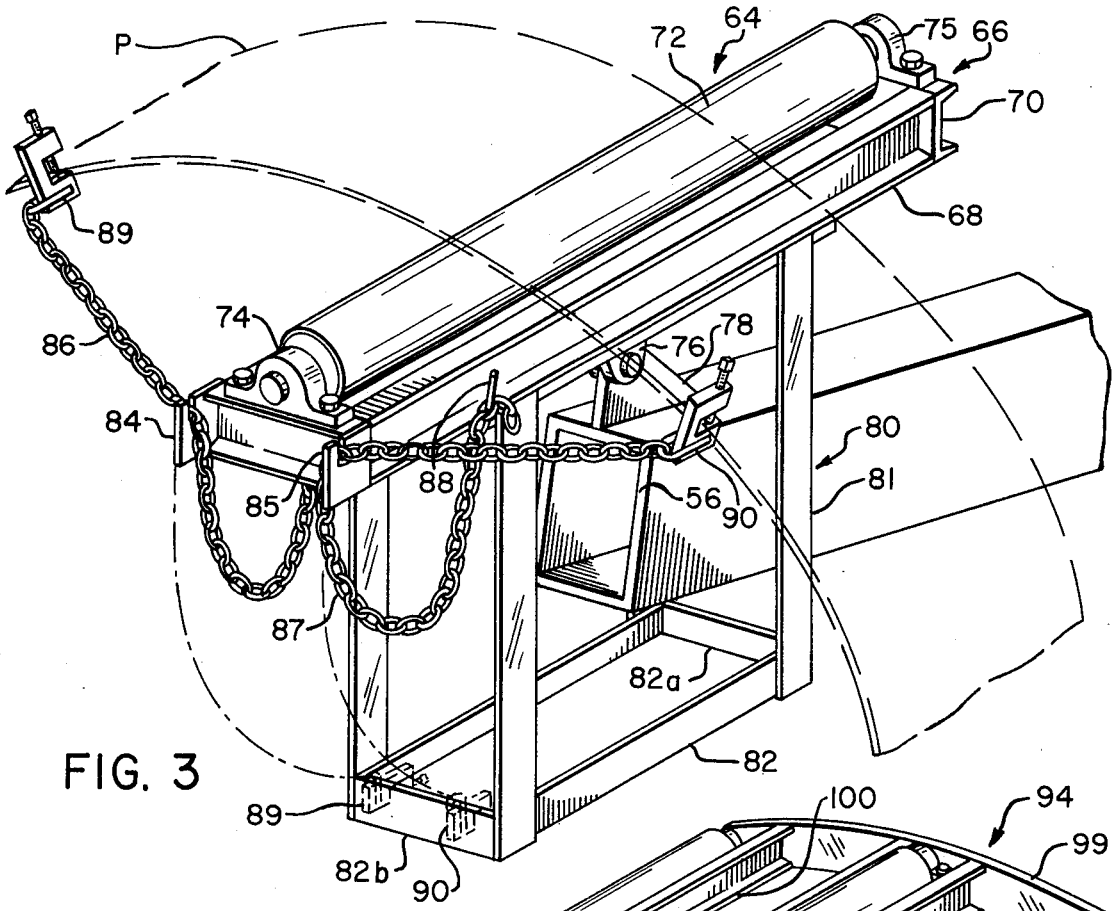
FIG. 3 is a perspective view of the plate support carriage portion of the loader and unloader of FIGS. 1 and 2.

Referring first to FIGS. 1 and 2, a conventional plate roll machine, indicated generally at 10, includes a base frame 12 supporting upright frame portions 14, 16, 18, 20. The illustrated plate roll machine includes a group of three parallel driven plate rolls, including a top roll 22 and two bottom rolls 24, rotatably supported in upright frame portions 18, 20 and rotatably driven by drive shaft extensions 26, 28 from a d.c. electric motor and associated drive train within a housing 30. Power is supplied to the d.c. electric motor from a d.c. generator 32 driven by an a.c. electric motor 34, both mounted atop a raised platform 36.

The three plate rolls are usually arranged as a group in pyamid fashion or in initial fashion, depending on the type of plate roll machine, and are laterally separable to accomodate different plate thicknesses and to apply variable pressures to a flat plate fed therebetween so as to roll the plate to different diameters as desired. The end roll support 20 includes a portion 21 that can be swung downwardly and away from the outer ends of the plate rolls 22, 24 to enable endwise insertion of a steel plate between the rolls from the outer ends thereof and endwise unloading of a rolled plate from between the rolls while top roll 22 is separated from the bottom two rolls 24.

The present invention is intended to apply to all types of plate roll machines, using a grouping or stack of plate rolls in various arrangements to bend a flat plate into a curved shape. The plate roll machine is provided with suitable plate roll controls indicated generally at 38 and suitable electrical controls indicated generally at 39.

The loader and unloader for the described plate roll machine includes an extensible boom 40 overlying the machine and extending generally horizontally over and in spaced relation to the plate rolls 22, 24 in the longitudinal median plane of the machine, as will be apparent from FIG. 2. A pivot mounting 42 at the inner end of boom 40 mounts the boom to the upper end of a stationary upright frame support 44 supported on base frame 12 at the end of the machine farthest from the plate rolls. Boom 40 is mounted by its pivot mounting 42 for swinging movement in a vertical plane. Such movement is accomplished by a pair of vertically extending hydraulic cylinders 46 on opposite sides of the plate roll machine. The lower ends of cylinders 46 are pivoted to a cylinder support 48 extending upwardly from base frame 12. The upper ends of the piston rods for such cylinders are pivoted at 50 to arms 52 which extend laterally from the outer section of boom 40 between its opposite ends.

Boom 40 is a two-stage boom including an outer nonextensible boom stage or section 54 and an inner telescoping stage or section 56 which is extensible outwardly from its retracted position shown in FIGS. 1 and 2 by a long-stroke hydraulic cylinder 58 pinned at one end at 60 to the pivoted end of the outer boom section and extending inside the inner boom section 56 to an outer, piston rod end pivoted to an outer portion of the inner boom section at 62. Thus extension of cylinder 58 extends inner boom section 56 outwardly of the outer boom section 54 and retraction of such cylinder telescopes the inner boom section into the outer boom section.

Suitable boom controls 92 for raising and lowering and extending and retracting boom 40 are provided at a control station alongside the electrical control boxes 39. A hydraulic reservoir 91 provides a source of hydraulic fluid for the hydraulic lift and extension cylinders for the boom and also houses the pump for supplying pressure fluid to the cylinders, as dictated by boom controls 92.

The outer end of inner boom section 56 carries a plate support carriage 64 shown most clearly in FIG. 3. Carriage 64 includes a generally rectangular and horizontally oriented open support frame 66 made up of a pair of longitudinal side channel members 68 and a pair of transverse end channel members 70. A plate support roller 72 is rotatably supported atop the support frame 66 by journal bearings 74, 75 attached to the upper surfaces of the opposite end channel 70. A clevis 76 extends downwardly from a central portion of support frame 66 and is mounted by a clevis pin to an ear 78 projecting upwardly from an upper surface of the outer end of inner boom section 56. Thus clevis 76 and ear 78 with their interconnecting clevis pin pivotally mount the plate support carriage for fore-and-aft pivotal movement on the outer end of inner boom section 56 about a horizontal axis transverse to the longitudinal axis of the boom.

A deep open box-like frame structure, indicated generally at 80, extends downwardly from support frame 66 laterally outwardly of the boom and terminates below the lower limit of inner boom section 56. Such box frame structure includes four vertical frame members 81, two of which are rearwardly of the outer end of boom section 56 and two of which are forwardly of such outer end. Vertical frame members 81 are interconnected at their lower ends by horizontal frame members 82, the rearmost one **82*a* of which engages the undersurface of inner boom section 56 to limit forward tilting movement of the entire carriage structure 64. Rearward tilting movement of the carriage structure is limited by the innermost end of support frame 66 through engagement of such end with an upper surface of inner boom section 56.**

The forward end of support frame 66 includes a pair of vertically slotted chain hanger plates 84, 85 which support a pair of strand means, in this case chain lengths 86, 87 in various positions of adjustment. The chain lengths are supported at one end of each to opposite sides of the support frame 66 by chain-holding pins 88. The opposite ends of chain lengths 86, 87 carry plate clamps 89, 90 which are supported by the forward cross frame member **82*b* of box frame structure 80 when the clamps are not in use. When in use, such chains extend laterally outwardly from hanger plates 84, 85 and clamp to circumferentially spaced forward edge portions of a rolled plate P on opposite sides of roller 72 to prevent the rolled plate P from rolling on roller 72** during the unloading operation to be described. Thus the hanger plates provide a means for adjusting the effective lengths of the chains to accomodate various sizes of rolled plate.

Figure 4:
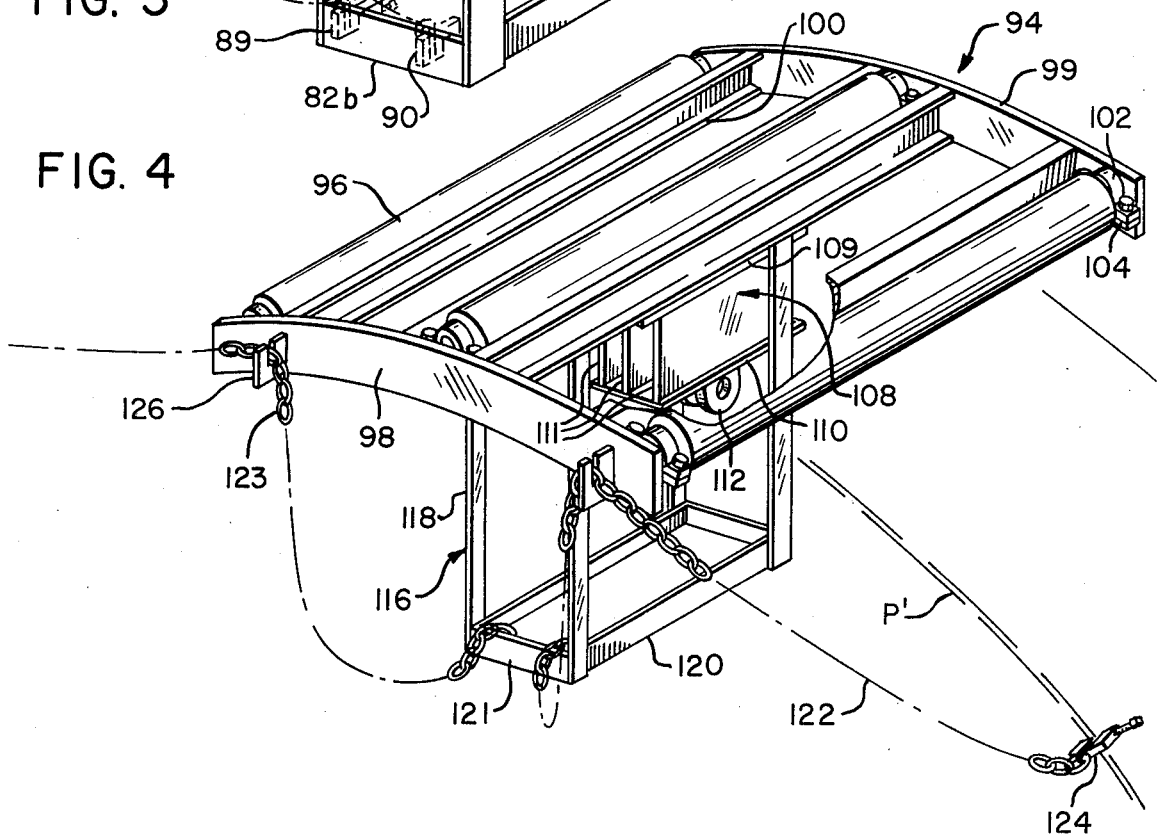
FIG. 4 is a perspective view of a modified form of the plate support carriage portion of the loader and unloader.

FIG. 4 Carriage Modification

FIG. 4 shows a modified form of carriage 94 which is interchangeable with the carriage 64 of FIG. 3 on the outer end of inner boom section 56. Whereas plate carriage 64 of FIG. 3 is a one-roller carriage, the plate carriage of FIG. 4 is a three-roller carriage. The three rollers 96 are of the same length and parallel to one another at transversely spaced positions with respect to the direction of boom extension. The three rollers are mounted between a pair of arcuate end frame members including a front frame member 98 and a near end frame member 99 joined together by longitudinal side channel members 100. Bearing members 102 rotatably mount the shaft ends of the three rollers 96 and are supported on bearing blocks 104 attached to the inside faces of the two end frame members 98, 99.

A pair of center longitudinal frame members 105, 106, shown best in FIG. 5, mount in depending relationship a box-like frame structure 108 made up of a top plate 109 and bottom plate 110 joined by three vertical plates 111. Depending from bottom plate 110 is a clevis 112 which receives the upwardly extending ear 78 at the outer end of the inner boom section 56 to pivotally mount the plate carriage to the boom end using the removable clevis pin 114. Thus, like the one-roll carriage 64 of FIG. 3, the three-roll carriage of FIG. 4 is mounted for fore-and-aft pivoting movement on the outer end of the inner boom section 56.

Also like the one-roll carriage 64, the three-roll carriage has a deep box-like open frame structure 116 depending from the main carriage frame. The depending open frame structure in the three-roll carriage includes the four vertical frame members 118 affixed near their upper ends to center channel members 105, 106 and joined at their lower ends by horizontal side frame members 120 and end frame member 121. This open box frame structure has the same purpose as described with respect to the frame structure of the one-roll carriage, that is, to carry the pair of chains 122, 123 with their end clamps 124 for selective attachment to the front edge of a rolled plate P' to prevent rotation of the plate over the rolls during the unloading operation. The front face of the front carriage support frame member 98 carries a pair of vertically slotted chain hanger plates 126 for adjusting the effective lengths of the chains for plate clamping purposes.

It will be apparent from FIGS. 4 and 5 that the three rolls 96 lie along a large radius imaginary curved surface. The purpose of the three-roll carriage is to support a rolled plate of very large diameter or very thin section. If the one-roll carriage is used in such applications, there is a danger of collapsing the heavy, large-diameter plate or the thin sectioned plate when it is wholly supported by the single roll during the unloading operation.

Operation

In operation, flat steel plate to be rolled is fed between the plate rolls in the usual manner and the plate roll pressure set to roll the plate to the desired diameter. As the plate is rolled, boom 40 is elevated by lift cylinders 46 until roll 72 of plate support carriage 64 lies at an elevation to support the rolled plate as it is formed, as shown in FIG. 6. The plate carriage serves in this capacity until the plate is completely rolled and ready for endwise unloading from the plate rolls 22, 24.

When the plate has been rolled, the removable end portion 21 of outer plate roll support 20 is released and swung away from the rolls, and top roll 22 is shifted vertically away from the two bottom rolls 24. Then lift cylinders 46 extend to raise boom 40 slightly until the rolled plate P is fully supported on carriage roll 72. Thereafter inner boom section 56 extends, moving plate P outwardly from between plate rolls 22, 24. This continues until plate P lies wholly beyond the outer end of the plate roll machine. At this point lift cylinders 46 retract, lowering boom 40 with inner boom section 56 still extended until plate P becomes ground-supported from below as shown in FIG. 8. When the plate is ground-supported, lift cylinders 46 retract fully, disengaging carriage roll 72 from the upper inside surface of rolled plate P. Inner boom section 56 then retracts back into outer boom section 54, withdrawing carriage 64 from within rolled plate P. Boom retraction continues until carriage 64 again overlies plate rolls 22, 24 at which point the plate roll machine is ready to receive the next flat plate for rolling.

With certain types of plate rolls, specifically plate rolls of the pyramid type which leave a slight tangent or flat section on the plate upon completion of rolling, it is necessary to reroll the plate upon completion of the first rolling operation as described so as to remove such tangent section. This is done by reversing the rolled plate in the plate rolls after the first rolling operation and then repeating the rolling operation. When this is necessary, the unloader can also be used as a loader, reversing the procedure just described with respect to FIGS. 6, 7 and 8 to load a plate, such as shown at FIG. 8, after it has been reversed end to end. To load the rolled plate into the plate rolls, the plate is lifted and inserted endwise between the top and bottom plate rolls 22, 24 while they are separated. Upon completion of the second rolling operation, the rolled plate is again unloaded endwise from between the plate rolls in the manner previously described.

Of course, for extremely large-diameter rolled plate and thin plate, the three-roll carriage of FIGS. 4 and 5 would be substituted for the single-roll carriage shown.

Having illustrated and described the principles of my invention by what is presently a preferred embodiment, it should be apparent to those skilled in the art that such embodiment may be modified in arrangement and detail without departing from such principles. I claim as my invention all such modifications as come within the true spirit and scope of the following claims.

I claim:

1. In a plate roll machine having plural long generally parallel cooperative plate rolls and a drive and control system including means at an inner end of said plate rolls for rotating said rolls and for selectively separating said rolls for inserting a workpiece therebetween from an opposite outer end of said rolls, loading and unloading means for said plate rolls comprising:

a longitudinally extensible boom extending generally horizontally over and in spaced relation to said rolls in the same general direction of elongation as said rolls, stationary frame means pivotally supporting an inner end of said boom for pivoting movement of said boom in a vertical plane of said rolls about a pivot axis positioned closer to said inner end than to said outer end of said rolls, boom-pivoting means for pivoting said boom about said pivot axis, boom extension means operable to extend and retract said boom between an extended position wherein an outer end of said boom is positioned outwardly beyond said outer end of said plate rolls and a retracted position wherein said outer end of said boom overlies said plate rolls, and carriage means mounted at said outer end of said boom for supporting a rolled plate at an upper inside surface thereof.

2. Apparatus according to claim 1 wherein said boom-pivoting means and said boom extension means comprise fluid motor means.

3. Apparatus according to claim 1 including means pivotally mounting said carriage means to said outer end of said boom for fore-and-aft pivotal movement about a horizontal pivot axis transverse to the longitudinal axis of said boom.

4. Apparatus according to claim 1 wherein said carriage means includes roller-type support means having an axis of rotation extending generally longitudinally of said boom for rotatably supporting said rolled plate from an upper inside surface thereof.

5. Apparatus according to claim 4 wherein said roller-type support means includes at least one long roller arranged to support a roller plate at an upper inside surface of said plate

6. Apparatus according to claim 4 wherein said carriage means includes a support frame means supporting said roller-type support means in a position above the outer end of said boom and centered in the vertical plane of movement of said boom.

7. Apparatus according to claim 6 wherein said support frame means is pivotally mounted to said outer end of said boom for limited fore-and-aft tilting movement about a pivot axis transverse to the longitudinal direction of said boom.

8. Apparatus according to claim 3 wherein said carriage means includes means limiting the forward tilting movement of said carriage means about said transverse pivot axis.

9. Apparatus according to claim 1 wherein said boom extension means includes means operable to extend said boom from its retracted position through a distance sufficient to cause the innermost end of a rolled plate supported by said carriage means to clear said outer end of said plate rolls, said boom-pivoting means including means operable to pivot said boom about its said pivot axis through a distance sufficient to lower said boom toward said plate rolls below a horizontal disposition to disengage said carriage means from a rolled plate in both the extended and retracted positions of said boom and sufficient to raise said boom to engage an upper inside surface of a rolled plate and support said plate in both said extended and retracted positions.

10. Apparatus according to claim 4 wherein said roller-type support means includes plural transversely spaced-apart parallel support rolls.

11. Apparatus according to claim 10 wherein said plural support rolls are arranged along an imaginary arcuate surface conforming to the curved surface of a large-diameter rolled plate to be supported by said rolls.

12. Apparatus according to claim 4 wherein said carriage means includes means selectively engageable with the rolled plate for restraining the rolled plate against rotation on said roller-type support means during loading and unloading of the plate from said plate rolls.

13. In a loader and unloader for a plate roll machine in which a group of parallel horizontal plate rolls driven from one end of said rolls are capable of being loaded from the opposite end of said rolls, a longitudinally extensible boom adapted to extend generally horizontally over said plate roll machine and above said group of plate rolls from a stationary support frame at an end of said machine spaced from said plate rolls, said boom being pivotally mounted at an inner end thereof to said support frame for movement of the opposite outer end of said boom in a vertical plane passing through and parallel to said group of plate rolls, boom-pivoting means operatively connected to an intermediate portion of said boom, boom extension means for extending the outer end of said boom between a retracted position in which said outer end overlies said group of plate rolls and an extended position in which said outer end is extended outwardly of said opposite end of said group of plate rolls, and carriage means pivoted to said outer end of said boom for limited fore-and-aft tilting movement about a horizontal pivot axis transverse to the length of said boom.

14. A loader-unloader according to claim 13 in which said carriage means includes a plate-engaging means positioned above the upper surface of said outer end of said boom and extending generally lengthwise of said boom for supporting a rolled plate from an upper inside of said plate.

15. A loader-unloader according to claim 14 wherein said plate-engaging means comprises at least one roller.

16. In a loader and unloader for a plate roll machine having an extensible boom pivoted at one end for vertical movement and extending over and generally parallel to plate rolls of said machine, a plate-supporting carriage means for said boom comprising;

a generally horizontally disposed plate support frame, means for pivotally mounting said support frame to an extensible outer end of said boom for fore-and-aft tilting movement with respect to said outer end about a horizontal transverse pivot axis and so that at least an upper portion of said support frame lies above said outer end of same boom, a plate-engaging means supported on said plate support frame above said pivot axis and above the upper limits of said support frame for engaging a rolled plate at an upper inside surface of said plate, and stop means for limiting the fore-and-aft tilting movement of said support frame with respect to said boom.

17. A loader and unloader according to claim 16 wherein said plate-engaging means comprises at least one support roll mounted on said support frame so as to have an axis of rotation extending lengthwise of said boom and in a plane of vertical movement of said boom.

18. A loader and unloader according to claim 17 including flexible strand means carried by said plate support frame and selectively attachable to edges of a rolled plate for restraining movement of the plate relative to said support roll during loading and unloading of the rolled plate from said plate roll machine.

* * * * *

UNITED STATES PATENT OFFICE

CERTIFICATE OF CORRECTION

PATENT NO. : 3,996,778

DATED : December 14, 1976

INVENTOR(S) : CHARLES H. SPARKS

It is certified that error appears in the above-identified patent and that said Letters Patent are hereby corrected as shown below:

Column 4, line 26, "near" should be --rear--;
Column 6, claim 5, line 39, after "plate" insert a period (.);
Column 8, claim 14, line 6, after "inside" insert --surface--;
Column 8, claim 16, line 22, "same" should be --said--.

Signed and Sealed this

Twelfth Day of April 1977

[SEAL]

*Attest:*

RUTH C. MASON
*Attesting Officer*

C. MARSHALL DANN
*Commissioner of Patents and Trademarks*